US006991187B2

(12) United States Patent
Czimmek

(10) Patent No.: US 6,991,187 B2
(45) Date of Patent: Jan. 31, 2006

(54) MAGNETO-HYDRAULIC COMPENSATOR FOR A FUEL INJECTOR

(75) Inventor: Perry Robert Czimmek, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 610 days.

(21) Appl. No.: 09/987,083

(22) Filed: Nov. 13, 2001

(65) Prior Publication Data

US 2002/0056768 A1 May 16, 2002

Related U.S. Application Data

(60) Provisional application No. 60/248,862, filed on Nov. 13, 2000.

(51) Int. Cl.
*B05B 1/30* (2006.01)
*F02M 51/00* (2006.01)
*F02M 39/00* (2006.01)

(52) U.S. Cl. ..... 239/585.1; 239/533.3; 239/585.5; 239/88; 239/533.9

(58) Field of Classification Search ... 239/585.1–585.5, 239/533.2, 533.3, 533.8, 533.9, 88–93, 533.7; 251/129.15, 129.21
See application file for complete search history.

(56) References Cited

U.S. PATENT DOCUMENTS 4,584,980 A 4/1986 Weiger et al.
4,610,426 A 9/1986 Brandner
4,803,393 A 2/1989 Takahashi
6,499,471 B2 12/2002 Shen et al.

FOREIGN PATENT DOCUMENTS

| | | |
|---|---|---|
| DE | 197 08 304 A1 | 9/1998 |
| DE | 197 27 992 A1 | 1/1999 |
| DE | 198 26 339 A1 | 12/1999 |
| DE | 198 38 862 A1 | 3/2000 |
| DE | 198 54 506 C1 | 4/2000 |
| DE | 198 56 617 A1 | 6/2000 |
| DE | 198 58 476 A1 | 6/2000 |
| DE | 199 02 260 A1 | 9/2000 |
| EP | 0 869 278 A1 | 10/1998 |
| JP | 63-158301 | 7/1988 |
| WO | WO 94/18449 | 8/1994 |

*Primary Examiner*—Davis Hwu

(57) ABSTRACT

An apparatus and method of compensating for thermal expansion and tolerance variations (wear, brinelling, mounting distortion) in a fuel injector is provided. The apparatus includes a magneto-hydraulic thermal expansion compensator containing magnetically-active fluid positioned in operative contact with the fuel injector actuation element. A electromagnetic coil is provided proximate the magneto-hydraulic compensator. Magnetic flux generated by the electromagnetic coil causes the viscosity of the magnetically-active fluid within the magneto-hydraulic compensator to increase, causing the magneto-hydraulic compensator to become substantially rigid during actuation of the fuel injector.

16 Claims, 8 Drawing Sheets

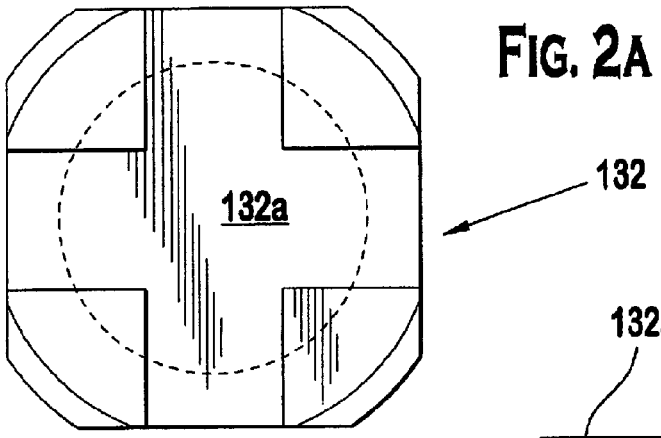
FIG. 2A
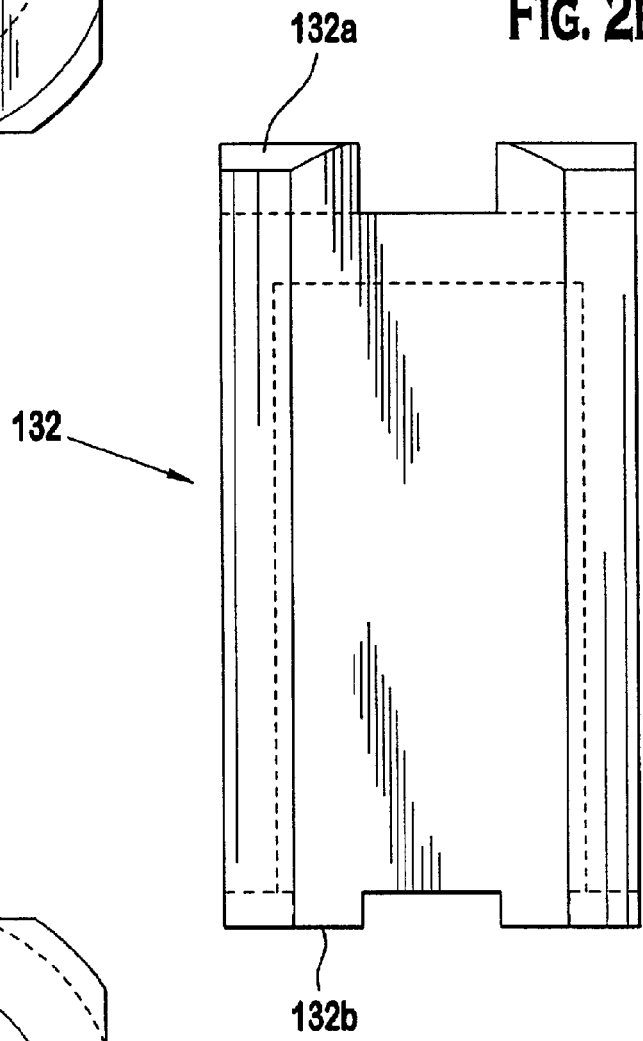
FIG. 2B
FIG. 2C
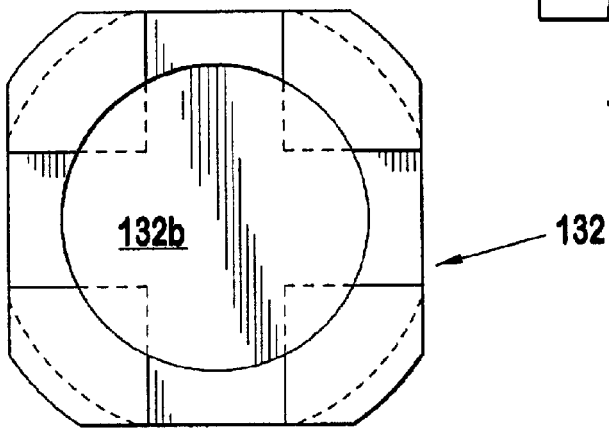

MAGNETO-HYDRAULIC COMPENSATOR FOR A FUEL INJECTOR

Priority

This application claims the benefit of U.S. Provisional Application No. 60/248,862 filed November 13, 2000, which is hereby incorporated by reference in its entirety.

Field of the Invention

This invention relates to high-speed electronic actuators such as magnetostrictive, piezostrictive for actuators such as, for example, fuel injector and valve timing actuators and particularly to fuel injectors for internal combustion engines. More particularly, this invention relates to an apparatus and method of compensating for thermal expansion and tolerance stackup in fuel injectors and similar metering devices and actuators. Even more particularly, a fuel injector utilizing magnetostrictive transduction as its actuation method and a method of construction and compensation for tolerance stack up and thermal expansion of such an injector.

Background of the Invention

A conventional method of actuating a valve, such as, for example, a fuel injector is by use of an electro-mechanical solenoid arrangement. The solenoid is typically an insulated conducting wire wound to form a tight helical coil. When current passes through the wire, a magnetic field is generated within the coil in a direction parallel to the axis of the coil. The resulting magnetic field exerts a force on a moveable ferromagnetic armature located within the coil, thereby causing the armature to move a needle valve into an open position in opposition to a force generated by a return spring. The force exerted on the armature is proportional to the strength of the magnetic field; the strength of the magnetic field depends on the number of turns of the coil and the amount of current passing through the coil.

In the conventional fuel injector, the point at which the armature, and therefore the needle, begins to move varies primarily with the spring preload holding the injector closed, the friction and inertia of the needle, fuel pressure, eddy currents in the magnetic materials, and the magnetic characteristics of the design, e.g., the ability to direct flux into the working gap. Generally, the armature will not move until the magnetic force builds to a level high enough to overcome the opposing forces. Likewise, the needle will not return to a closed position until the magnetic force decays to a low enough level for the spring to overcome the fuel flow pressure and needle inertia. In a conventional injector design, once the needle begins opening or closing, it may continue to accelerate until it impacts with its respective end-stop, creating wear in the needle valve seat, needle bounce, and unwanted vibrations and noise problems.

Another conventional method of actuating a valve such as, for example, a fuel injector is by use of a piezoelectric actuator comprising a stack of piezoceramic or piezocrystal wafers bonded together to form a piezostack transducer. The piezostack transducer is operatively attached to the needle valve or similar member. Transducers convert energy from one form to another and the act of conversion is referred to as transduction. The piezoelectric transducer converts energy in an electric field into a mechanical strain in the piezoelectric material. Accordingly, when the piezostack has a high voltage potential applied across the wafers, the piezoelectric effect causes the stack to change dimension. This dimensional change in the piezostack may be used to actuate the needle valve. The piezostack applies full force during the armature travel, allowing for controlled trajectory operation, and the characteristic ultrasonic operation of the piezostack provides good fuel atomization. However, the piezostack may fail to function when exposed to fuel or other engine fluids. Thus, in order to enable the piezostack to function properly, additional injector components may be required to isolate the piezostack from the engine environment and fuel, while allowing the useful motion of the piezostack to remain operatively coupled to the injector valve.

Yet another method of actuating a valve, such as a fuel injector is by use of a magnetostrictive member that changes length in the presence of a magnetic field. The dimensional changes that occur when a ferromagnetic material is placed in a magnetic field are normally considered undesirable effects because of the need for dimensional stability in precision electromagnetic devices. Therefore, manufacturers of ferromagnetic alloys often formulate their alloys to exhibit very low magnetostriction. However, ferromagnetic materials exhibit magnetic characteristics because of their ability to align magnetic domain. Strongly magnetostrictive materials characteristically have magnetic anisotropy closely coupled with magnetostrictive anisotropy, thus allowing the domains to change the major dimensions of the ferromagnetic material when the domains rotate. The magnetostriction materials are, in practice, not sensitive to field polarity, thereby giving the same magnitude of extension regardless of the polarity of the magnetic field, which is dissimilar to a piezostack transducer in that the piezostack is sensitive to the polarity of the electric field being applied to the piezostack.

The alloying of the elements Terbium (Th), Dysprosium (Dy), and Iron (Fe) to form $Tb_xDy_{1-x}Fe_y$ allowed for useful strains to be attained. For example, the magnetostrictive alloy Terfenol-D ($Tb_{0.32}Dy_{0.68}Fe_{1.92}$) is capable of approximately 10 um displacements for every 1 cm of length exposed to an approximately 500 Oersted magnetizing field. The general equation for magnetizing force, H, in Ampere-Turns per meter (1 Oersted =79.6 AT/m) is:

H=IN/L, where I=Amperes of current; N=number of turns; and L=path length.

Terfenol-D is often referred to as a "smart material "because of its ability to respond to its environment and exhibit giant magnetostrictive properties. The present invention will be described primarily with reference to Terfenol-D as a preferred magnetostrictive material. However, it will be appreciated by those skilled in the art that other alloys having similar magnetostrictive properties may be substituted and are included within the scope of the present invention.

In the aforementioned methods of actuating a fuel injector, various materials are typically used, each having a unique coefficient of thermal expansion. Accordingly, thermal expansion compensation may be necessary to ensure acceptable performance over the wide range of temperatures encountered in automotive applications. For example, in the piezoelectric injector, the piezostack has a thermal expansion coefficient of nearly zero, while the steel used in injectors typically has a positive coefficient of thermal expansion. Without thermal expansion compensation, the injector may not operate properly over the required range of temperatures.

It is believed that previous methods of compensating for thermal expansion in fuel injectors may, in certain circumstances, suffer degraded performance and may be inefficient in terms of manufacturing costs. For example, it is believed that previous thermal expansion compensation techniques that rely on hydraulic thermal expansion compensation generally require compensators having closely toleranced internal components and often a check valve assembly, possibly increasing component cost and sensitizing the performance of the compensator to temperature as the viscosity of the hydraulic fluid changes with temperature.

Similarly, use of spring lash compensation techniques to compensate for thermal expansion may require precise heat treatment of the steel and blending of the alloys in order to obtain repeatable performance. Thermal compensation techniques that rely on matching of thermal expansion coefficients of injector components may require precise tolerancing of component lengths to maintain tolerance stackup effects within acceptable limits over a wide range of temperatures. Thermal compensation techniques using a tail mass with a hydraulic damper rely on inertial damping effects provided by a relatively large tail mass and often require a piston ring or O-ring seal for the hydraulic damper portion. Magnetic clamp thermal compensation techniques are similar to tail mass compensation techniques except that the magnetic clamp compensation techniques substitutes static friction and magnetic clamping force for the inertial damping effect provided by the tail mass, thereby eliminating the need for an O-ring seal around the piston section.

However, it is believed that degraded performance may occur with the tail mass with a hydraulic damper and magnetic clamp approaches, because both of these approaches to thermal expansion compensation typically utilize the fuel available in the injector as the hydraulic fluid. Use of fuel as the hydraulic fluid may reduce damper performance when, for example, the fuel pressure drops to the point that the dynamics of the damper cause cavitation or vaporization of fuel, when the fuel pressure is low enough to cause hot fuel to form vapor bubbles in the damper, in situations where the vehicle is expected to start with very low initial fuel pressure, or when the vehicle is expected to continue to run during fuel system failures that cause the fuel pressure to fall abnormally low. In addition, hydraulic dampers that rely on fuel as the hydraulic fluid may not always open sufficiently to bleed air out of the injector during initial start-up of the vehicle.

Summary of the Invention

The present invention provides a fuel injector that utilizes a length-changing actuator, such as, for example, an electrostrictive, magnetostrictive, piezoelectric or another solid-state actuator with a compensator assembly that compensates for thermal distortions, brinelling, wear and mounting distortions. The compensator assembly utilizes a minimal number of elastomer seals to increase reliability by reducing a total number of seals, of which a percentage can fail while achieving a more compact configuration for a compensator assembly. In one preferred embodiment of the invention, the fuel injector comprises a body having an inlet port, an outlet port and a fuel passageway extending from the inlet port to the outlet port, a metering element disposed proximate the outlet port, an actuation element having a proximal end and a distal end, the proximal end being in operative contact with the metering element, an electromagnetic coil, and a compensator. The compensator being coupled to the distal end of the actuation element and contains magnetically-active fluid. The magnetically-active fluid is responsive to magnetic flux so as to change the fluid from a first state to a second state.

The present invention further provides a method of compensating for distortion of a fuel injector due to thermal distortion, brinelling, wear, mounting or other distortions. The method also allows the compensator to form stiff reaction base on which an actuator can react against during actuation of the fuel injector. The fuel injector has a body with an inlet port, an outlet port and a fuel passageway extending from the inlet port to the outlet port, a metering element disposed proximate the outlet port, an actuation element having a proximal end and a distal end, a compensator and an electromagnetic coil. The compensator has a plunger disposed in a sleeve with a clearance between the plunger and the sleeve. The compensator contains magnetically-active fluid disposed for movement within the compensator. In a preferred embodiment, the method is achieved by changing the magnetically-active fluid in the compensator from a first state to a second state when a magnetic flux is generated; and maintaining one end of the actuation element constant with respect to the compensator when the magnetic flux is generated.

Brief Description of the Drawings

The accompanying drawings, which are incorporated herein and constitute part of this specification, illustrate presently preferred embodiments of the invention, and, together with the general description given above and the detailed description given below, serve to explain features of the invention.

FIG. 2*a* depicts an end view of a magneto-hydraulic compensator sleeve in accordance with a preferred embodiment of the present invention.

FIG. 2*b* depicts a sectional view of a magneto-hydraulic compensator sleeve in accordance with a preferred embodiment of the present invention.

FIG. 2*c* depicts an end view of a magneto-hydraulic compensator sleeve in accordance with a preferred embodiment of the present invention.

Detailed Description of the Preferred Embodiments

The presently preferred embodiments will be described primarily in relation to magnetostrictive fuel injectors.

However, as will be appreciated by those skilled in the art, these embodiments are not so limited and may be applied to any type of actuator requiring thermal expansion compensation including, for example, electrostictive, magnetostrictive, and piezoelectric fuel injectors, electronic valve timing actuators, fiel pressure regulators or other applications requiring a suitably precise actuator, such as, to name a few, switches, optical read/write actuator or medical fluid delivery devices.

Figure 1:
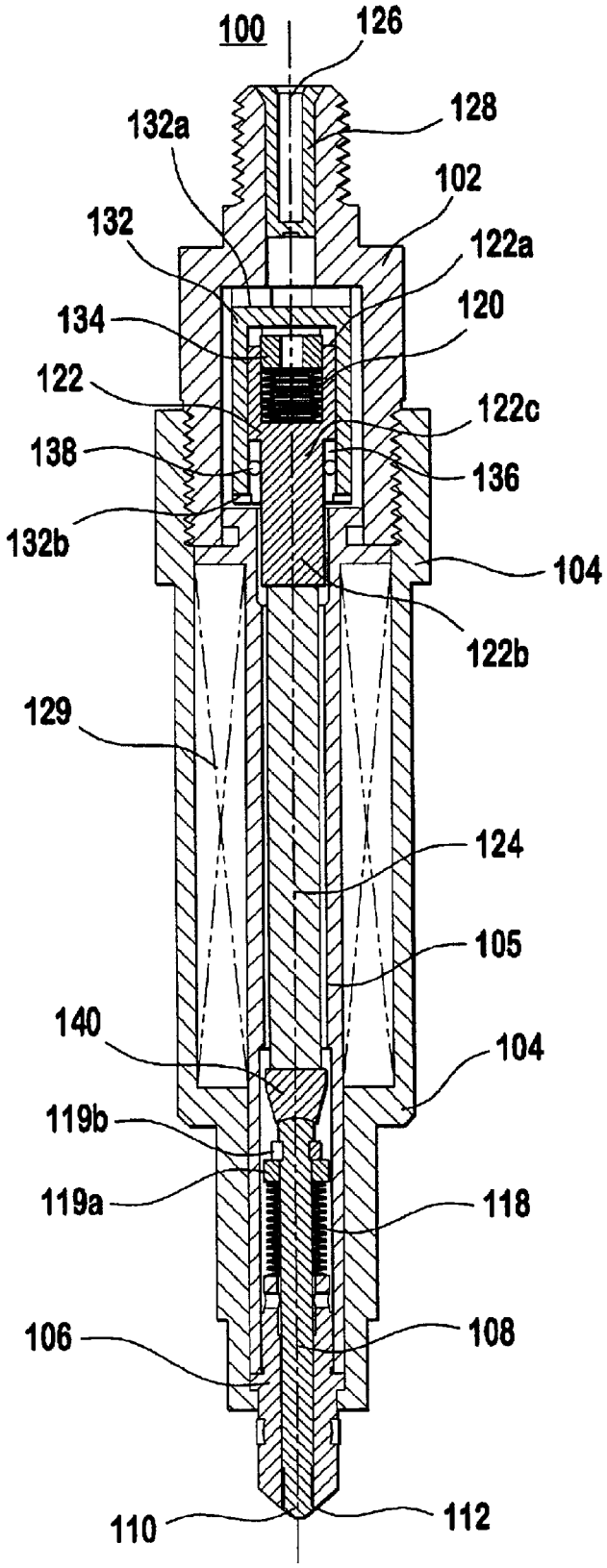
FIG. 1 is a sectional view of a magnetostrictive fuel injector in accordance with a preferred embodiment of the present invention.
Figure 3A:
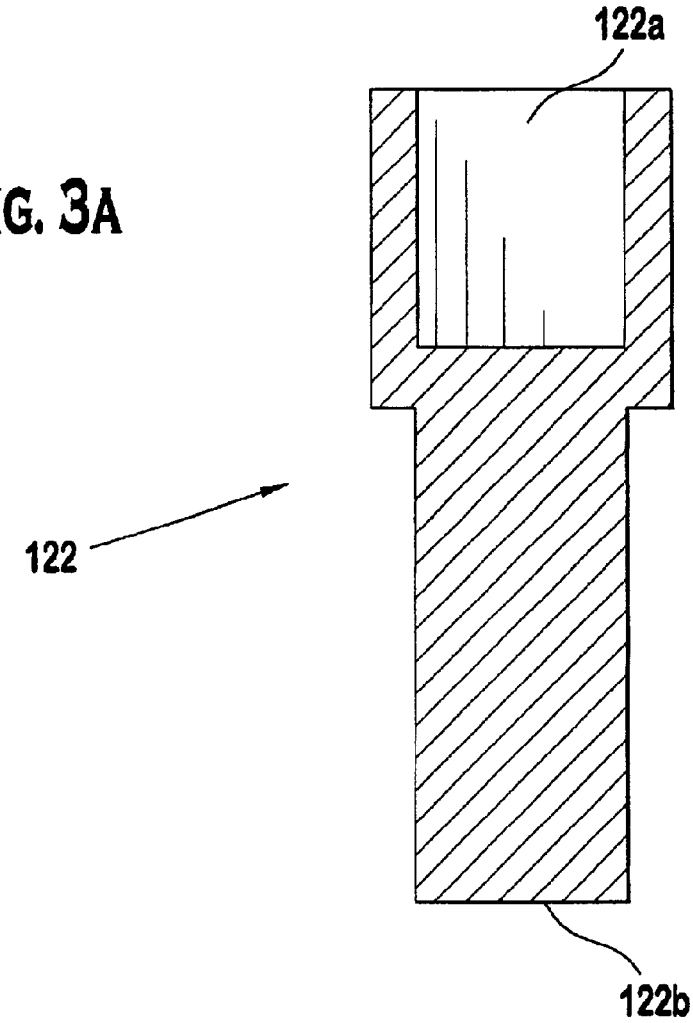
FIG. 3*a* depicts a sectional view of a magneto-hydraulic compensator plunger in accordance with a preferred embodiment of the present invention.
Figure 3B:
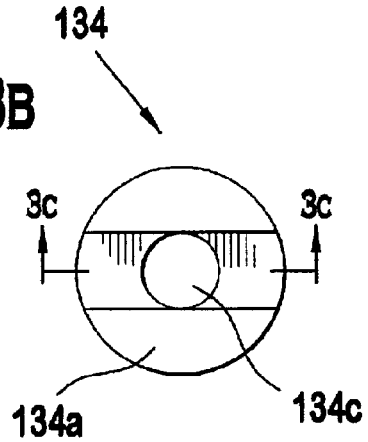
FIG. 3*b* depicts a sectional view of a magneto-hydraulic compensator guide in accordance with a preferred embodiment of the present invention.
Figure 3C:
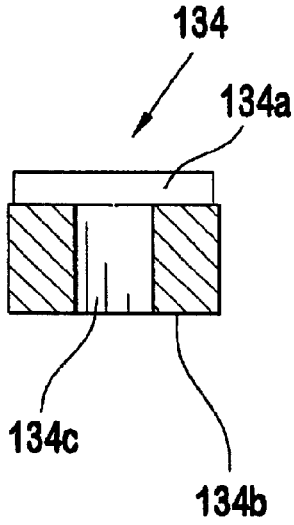
Figure 4:
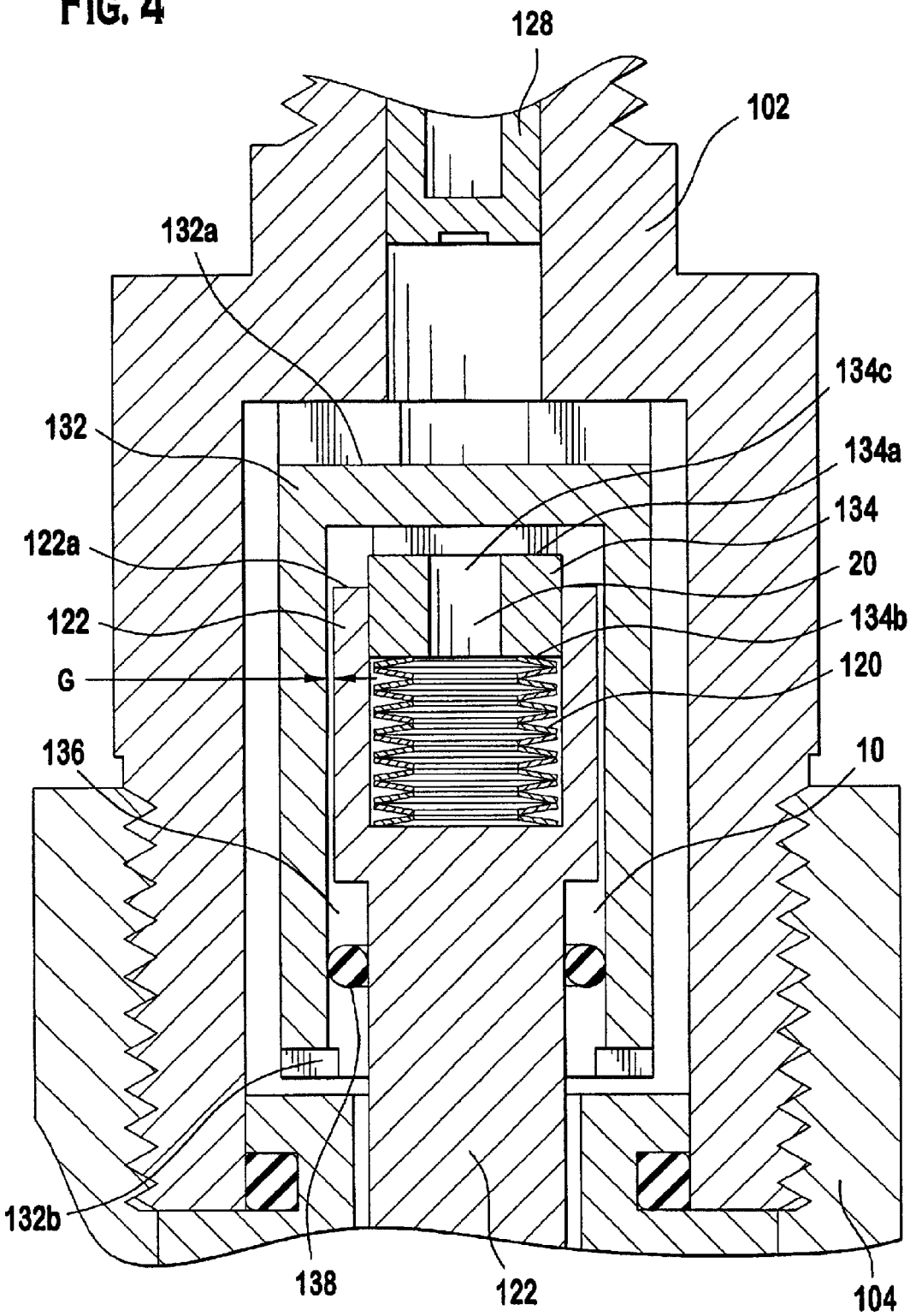
FIG. 4 depicts an enlarged view of the compensator assembly of FIG. 1 in accordance with a preferred embodiment of the present invention.
Figure 7:
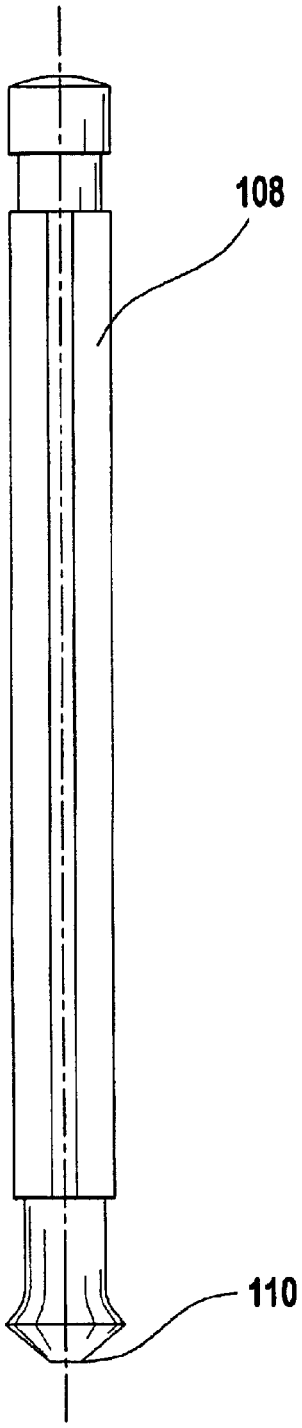
FIG. 7 depicts a metering element of the fuel injector of FIG. 1.
Figure 8:
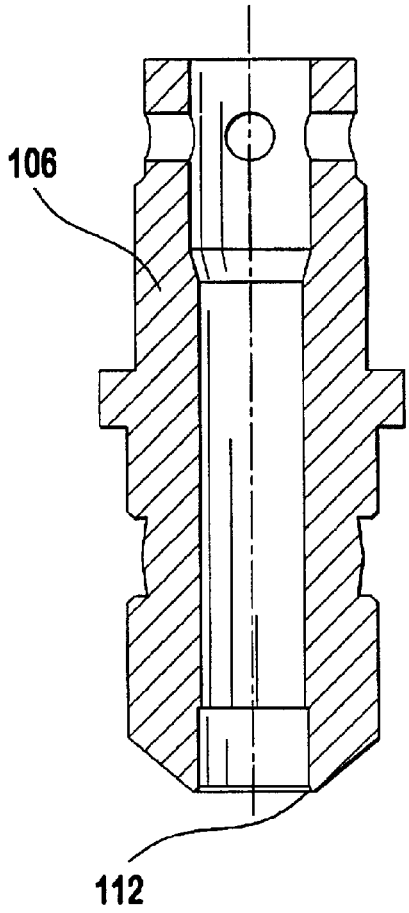
FIG. 8 depicts a valve body of the fuel injector of FIG. 1.
Figure 9:
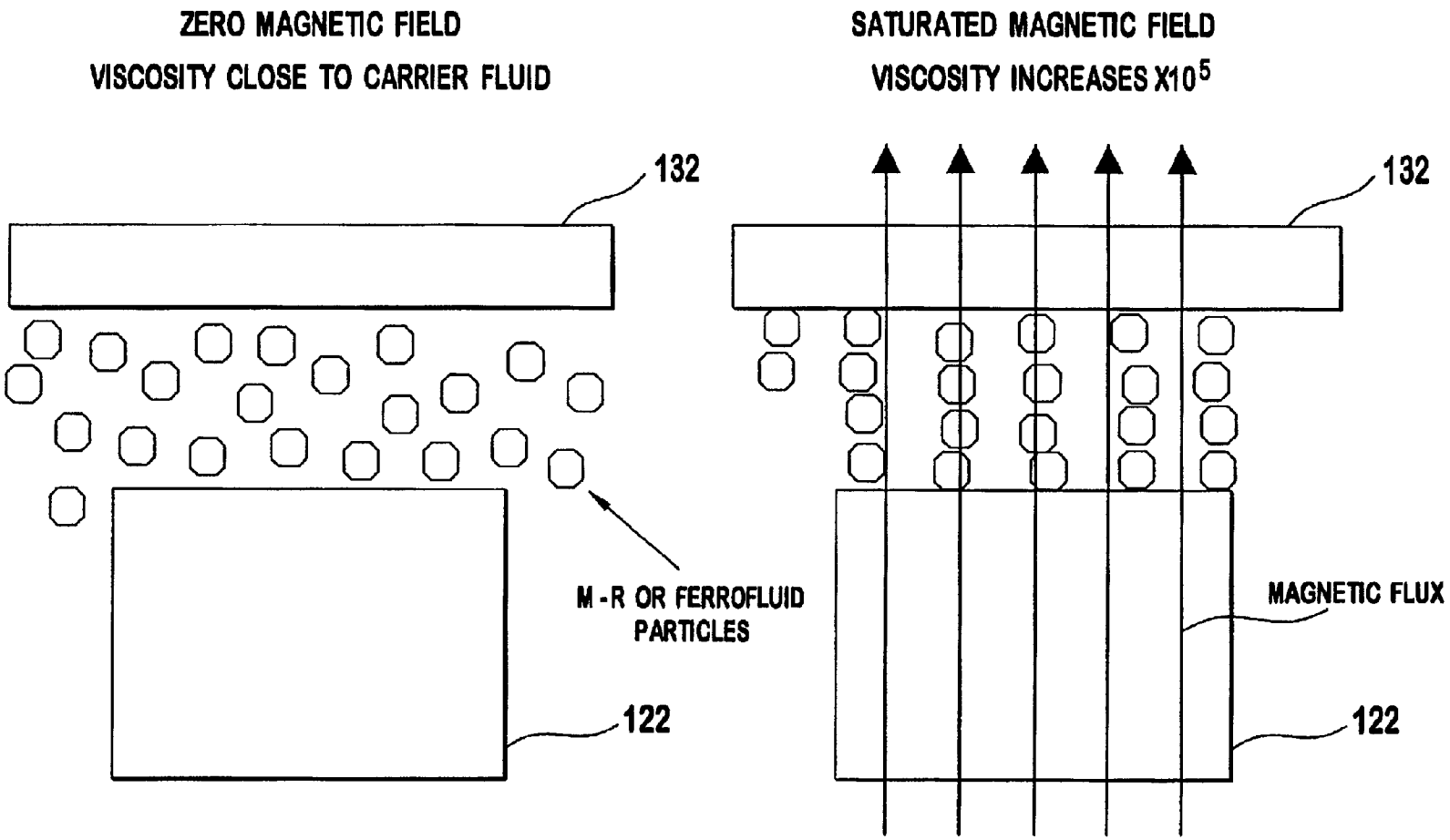
FIG. 9 depicts, in schematic form, the effect of a magnetic field upon a magnetically active fluid.

FIG. 1 illustrates an exemplary magnetostrictive fuel injector 100 in accordance with a presently preferred embodiment. The fuel injector 100 comprises an inlet assembly 102 coupled to a magnetic shell 104 that cinctures a non-magnetic shell 105. The magnetic shell 104 can also partially enclose a valve body 106 and a closure member 108. The magnetic shell 104 can be affixed to the valve body 106 and the inlet assembly 102 by a suitable technique, such as, for example, threading, welding, laser welding, bonding, brazing, gluing. Preferably, the non-magnetic shell 105 is laser welded to the valve body and the magnetic shell 104 is threaded to the inlet assembly 102 so as to form a structural member. The closure member 108 has a tip 110 forming a valve in conjunction with an injector seat 112. A first biasing member 118 is coupled to the closure member 108 (FIG. 7) by at least washer 119*a* and keeper 119*b* to urge the tip 110 into a sealing position with the injector seat 108 of the valve body 106 (FIG. 8). A second biasing member 120 exerts a force on a magneto-hydraulic plunger 122, which is, preferably, aligned with the closure member 108 and a magnetostrictive member 124. The magnetostrictive member 124 can be of any suitable cross-sectional shape, such as, for example, circular, oval or polygonal. Preferably the member 124 has a circular cross-sectional shape.

The first biasing member 118 is believed to enhance the alignment of magnetic moments perpendicular to the axis of desired motion due to the force exerted by biasing member 118 to the magnetostrictive member 124 (i.e. a "pre-stressing" of the member 124). This pre-stressing is believed to increase the displacement and output force of the magnetostrictive member 124. Likewise, the second biasing member 120 also prestresses the magnetostrictive member 124 and is inherently aided by the operation of the compensator assembly 130 to ensure a sufficiently stiff reaction base on which the magnetostrictive member 124 can react against during an injection event. Additionally, the second biasing member 120 also operates as a mechanism for "refilling" fluid between two or more hydraulic volumes or reservoirs disposed within the compensator assembly 130.

Figure 5:
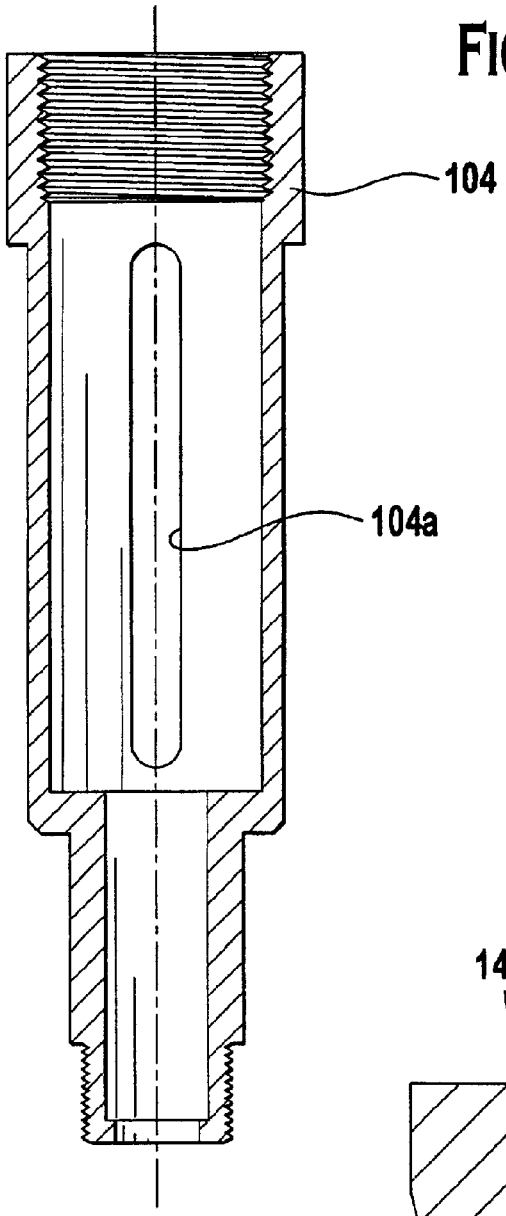
FIG. 5 depicts a magnetic shell of the fuel injector of FIG. 1.

A fuel inlet 126 is disposed on the inlet assembly 102. The fuel inlet 126 can include a fuel filter 128. The magnetostrictive member 124 is coaxially arranged with a electromagnetic coil winding 129. The coil winding 129 can be enclosed by the magnetic shell 104 (illustrated in FIG. 5). The magnetic shell 104 is operative to retain both the inlet portion 102 and the valve body 106. Preferably, the magnetic shell 104 can include slots 104*a*, through holes, openings or other features formed on its surface to break-up or reduce recirculating eddy currents that can occur when the coil 129 is de-energized In preferred embodiments, the actuation of the injector can be in the form of an outward opening injector needle, as depicted in FIG. 1, or an inward opening injector needle (not shown). Preferably, the first biasing member 118 can be a Bellville spring or spring stacks operatively disposed so as to provide approximately 490N of spring force in a first direction along the longitudinal axis of the injector, and the second biasing member 120 can be a Bellville spring or spring stacks operatively disposed so as to provide approximately 225N of spring force in a second direction opposite to the first direction. Alternatively, the first and second biasing members can be coil spring with at least one predetermined spring characteristic. As used throughout this disclosure, the at least one predetermined spring characteristic for a coil spring or a Bellville stack spring can include, for example, the spring constant, spring free length and modulus of elasticity of the spring. Each of the spring characteristics can be selected in various combinations with other spring characteristic(s) described above so as to achieve a desired response of the compensator assembly.

Figure 6:
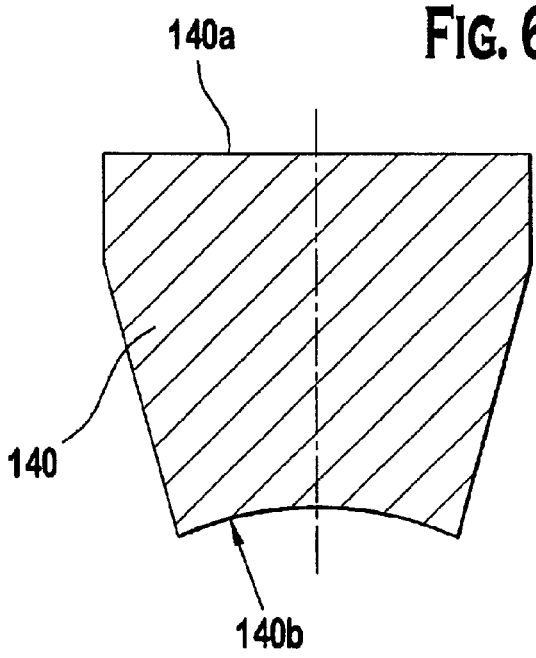
FIG. 6 depicts a magnetic transfer cap in the fuel injector of FIG. 1.

The magnetostrictive member 124 is coupled to the closure member by a magnetic transfer cap 140. As illustrated in FIG. 6, the magnetic transfer cap has a flat portion 140*a* and a radiused portion 140*b*. The transfer cap 140 is believed to reduce side loads introduced to the compensator assembly 130 by movement of the magnestrictive member 124 that would then increase the friction and hysteresis in the compensator assembly 130. As such, the magnetostrictive member 124 is preferably coupled to the closure member 108 by the magnetic transfer cap 140 (via the flat portion and the radiused portion) so as to reduce or even eliminate any side loads that can be introduced to the compensator assembly 130.

In a presently preferred embodiment, the magnetostrictive fuel injector 100 flrther includes a magneto-hydraulic compensator assembly 130 (depicted in FIGS. 1–4). In particular, the compensator 130 includes a sleeve 132 extending between a first end 132*a* and a second end 132*b* along the longitudinal axis. One of the first and second ends of the sleeve 132 has an opening (132*b*) and the other of the first and second end (132*a*) terminates in a blind bore, i.e. an upside down cup-shaped sleeve (FIGS. 2*a–c*). Partly disposed in the sleeve 132 is a plunger 122 extending between a first plunger end 122*a* and a second plunger end 122*b* along the longitudinal axis (FIG. 3*a*). The sleeve 132 (Fig.1) surrounds the first plunger end and an intermediate portion 122*c*. The plunger is spaced apart with a portion of the plunger by a clearance gap "G" (FIG. 4) so as to provide for a clearance fit between these two components. Preferably, the plunger 122 can include a hollowed out section formed on the first end 122*a* of the plunger 122 which extends into the plunger 122 for a predetermined distance so as to form an interior volume. A seal 138 can be located between the sleeve and the plunger so as to define a first volume 10 between sleeve 132 and the plunger 122, which volume can also include the clearance gap "G" and a portion near the first end 132*a*. A plunger guide 134, with a fluid passage 134*c* extending between a first guide end 134*a* and a second guide end 134*b*, is partly disposed in the hollowed out section of the plunger 122 to define a second volume 20. It should be noted that the clearance G between the plunger 122 and sleeve 132 may be adjusted so as to provide for a predetermined flow of magnetically-active fluid 136 between the first volume 10 and the second volume 20, depending on the properties of the type(s) of magnetically-active hydraulic fluid used. The guide 134 may be provided to maintain alignment of the plunger 122 within the sleeve 132 and to provide a seat for the second biasing member 120. Preferably, the seal 138 is a barrier type seal that is operative to prevent magnetically-active fluid 136 from leaking out of the compensator assembly 130 in any appreciable amount. Also preferably, the seal 138 should include relatively long glands area to allow movements of the seal 138 as the magnetically-active fluid 136 changes volume in the compensator assembly 130 due to thermal or other distortions. It should be noted, however, other types of barrier seal, for example, a labyrinth seal, or a plurality of o-ring seals can be used.

In operation, fuel is introduced into inlet 126 under pressure from a pressurized source (not shown) which, in direct injection applications, can be from 60 bars to over 100 bars. The pressurized fuel impinges against a surface 132*a* which transmits such pressure to the magnetically-active fluid 136 disposed in the first volume 10 and the second volume 20 of the compensator assembly 130. The plunger 122, being acted upon by the pressurized magnetically-active fluid 136 (by the pressurized fuel), tends to move toward the tip 110. Any backlash or clearance between the plunger 122, the magnetostrictive member 124, magnetic cap 140 and closure member 118 is believed to be eliminated by pressurization of the fluid 136 by the pressurized fuel via the sleeve 132. Additionally, any distortion, such as, for example, by an increase in temperature, wear, mounting or brinelling can be compensated by preselecting a fluid with a desired thermal coefficient B such that the distortion(s) can be compensated by corresponding expansion or contraction of the magnetically-active fluid 136.

During an injection pulse, an actuation signal (or signals) is sent to the coil 129 which then generates a magnetic flux field. The magnetic flux field is coupled by the magnetic housing 104 and non-magnetic shell 105 to cause the magnetostrictive member 124 to expand lengthwise. At approximately the same time, the magnetic flux causes a change in the viscosity of the magnetically active fluid 136 in a generally linear relationship with the intensity of the magnetic field such that the fluid 136 behaves similarly to a solid or a fluid in a liquid state that is solidified so as to be akin to a fluid in a solid-state form. This change in viscosity, for all practical consideration, is nearly instantaneous. At this point in the injection pulse, the fluid 136, when magnetized, generally prevents nearly or almost all flow between the first volume 10 and the second volume 20 due to the nearly solidified fluid 136. Thus, the compensator is nearly solid, thereby permitting a sufficiently stiff reaction base on which the magnetostrictive member 124 can work against so as to open the closure member 108 while maintaining the relative position between one end of the actuation element constant with respect to the compensator throughout the injection event.

In the absence of a magnetic field, the fluid 136 remains liquid, allowing the plunger 122 to sufficiently bleed the hydraulic fluid to accommodate slow dimensional and volume changes that occur due to temperature variations, without affecting the sealing performance of the closure member 108. The plunger clearance within the sleeve 132 and the length of the plunger 122 may be adjusted according to the desired compensator performance and the size of suspended particles in the magnetically-active hydraulic fluid, as well as the initial viscosity of the carrier fluid.

Returning to a time period during the injection event, the acceleration of the closure member 108 during the opening phase of the injector may cause the plunger 122 to also experience acceleration. However, due to the trapped hydraulic volume behind the plunger, and the increased damping response resulting from the increased fluid viscosity, preferably an increase of four or more orders of magnitude, caused by the presence of a magnetic field (preferably, the sane magnetic field that causes the magnetostrictive member 124 to expand), the acceleration of the plunger 122 will be a fraction of the needle's acceleration, resulting in the displacement of the plunger 122 being a fraction of the displacement of the closure member 108. While the magnetic field is maintained, the compensator limits the bleed of fluid around the plunger 122 (due to the increased viscosity of fluid 136), resulting in a stiff hydraulic volume, that for all practical consideration, acts as a rigid base on which the magnetostrictive member 124 can react against. Thus, it is believed that due to this rigid base, the remainder of the displacement of the magnetostrictive member 124 can be utilized towards moving the closure member 108 to an open configuration that dispenses fuel.

In a high speed injector, such as a direct injection injector, the above-described magneto-hydraulic compensator mechanism provides the performance necessary to open the closure member 108 and hold it open (by having one end of the magnetostrictive member fixed relative to the compensator while the other end is changing relative to position of the compensator) during characteristically short pulses (e.g., less than 120 milliseconds), while also compensating for slow changes in displacement, volume and component dimensions that result from extreme changes in temperature.

In a preferred embodiment, the opposing force holding the magnetostrictive member 124 against the closure member 108 and the first biasing member 118 is provided by the second biasing member 120 of preferably less pre-load than the first biasing member 118. Providing a larger pre-load on the first biasing member 118 ensures that the closure member 108 is closed against the seat 108 with sufficient force so as to prevent leakage of fuel due to filel pressure. As noted above, the second biasing member 120, by virtue of its location with respect to the plunger 122, also acts a refilling mechanism that, during a non-injection event, acts upon the plunger 122 in a direction toward the closure member 108 to draw fluid 136 into the second volume 20 from either the plunger clearance 123 or the first volume 10. Thus, this ensures that the plunger 122 is nearly always biased away from the sleeve 132 (i.e. "pumped up" configuration) instead of a first end 132*a* of the sleeve 132 abutting the first end 122*a* of the plunger 122 (i.e. a "collapsed" configuration).

Figure 10:
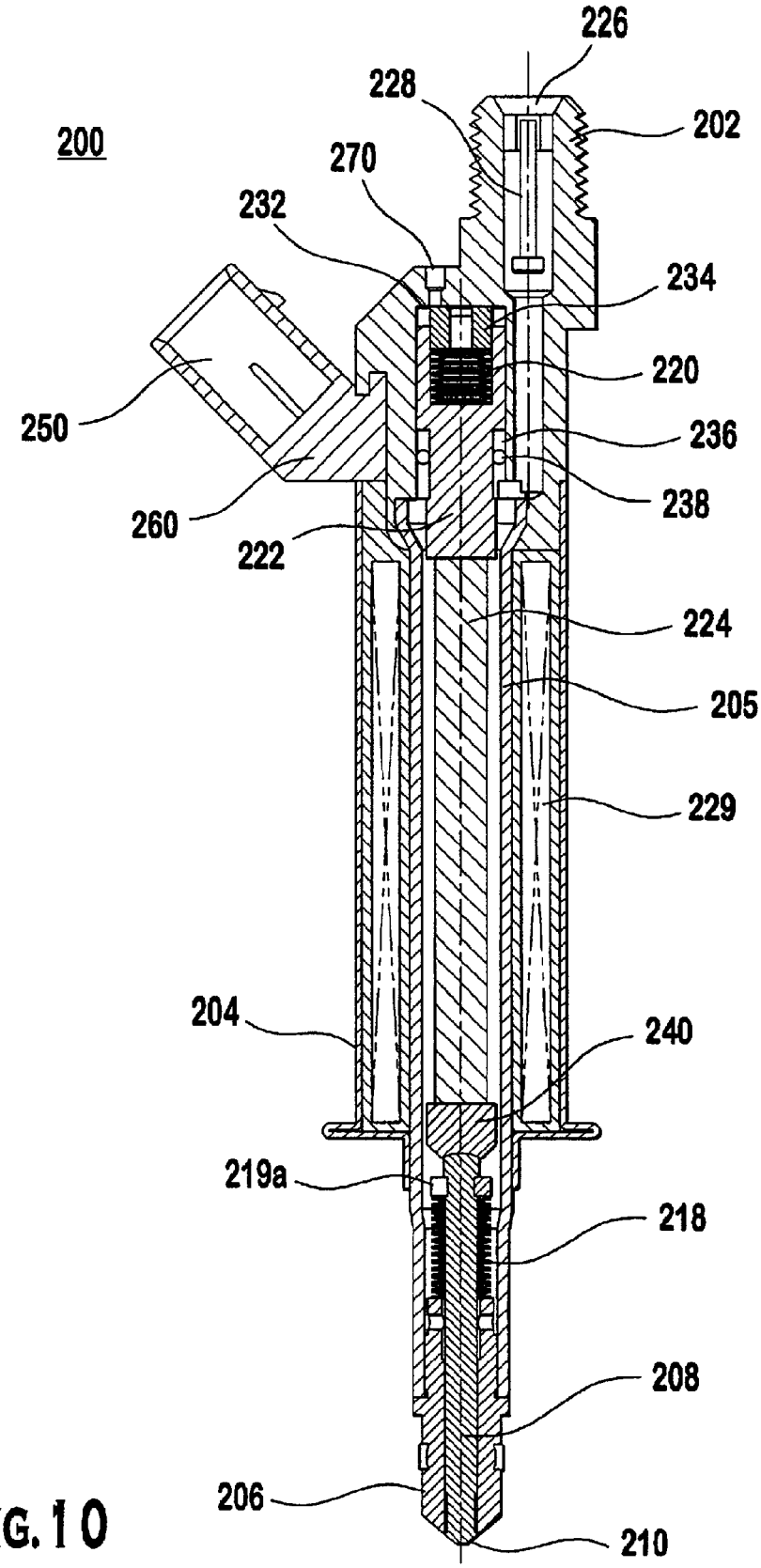
FIG. 10 depicts another variation of the fuel injector of FIG. 1.

In another preferred embodiment, as illustrated in FIG. 10, similar components to FIG. 1 are referenced with a numeral "2" instead of a numeral "1". Here, an injector 200 is provided with an electrical connector 250 with an offset fuel inlet arrangement that can include an integral sleeve formed in an inlet assembly 202. In the injector 200, the inlet connector 250 can be molded as part of an overmold that surrounds electromagnetic coil 229. The coil 229 is surrounded by a non-magnetic shell 205. The non-magnetic shell 205 can be affixed to an inlet assembly 202 and a valve body 206 by a suitable technique, such as, for example, threading, welding, bonding, brazing, gluing and preferably laser welding. A magnetic shell 204 can be affixed to the inlet assembly 202 and the non-magnetic shell 205 by a suitable technique, such as, for example, threading, welding, bonding, brazing, gluing and preferably laser welding such that both the magnetic shell 204 and the non-magnetic shell form a structural member that permits all other components to be mounted thereon. The inlet assembly 202 can include provision for a sleeve 232 formed in the inlet assembly 202. A filler hole 270 can be formed proximate the sleeve 232 so as to allow access to the compensator. In all other respect, however, the injector 200 is similar to the injector 100 and components of the injector 100 can be modified by one skilled in the art so as to be interchangeable with the components of the injector 200. Although not intended to be limited to these examples, the sleeve 132 of injector 100 can be an integrally formed with the inlet body, or the sleeve 232 of the injector 200 can be a separate piece as taught with reference to injector 100.

In a preferred embodiment, the magneto-hydraulic compensator takes advantage of the magnetic flux already existing around the magnetic circuit when the magnetostrictive element 124 (preferably Terfenol-D) is activated by the current flowing in the electromagnetic coil 129 of the injector. However, in an alternative preferred embodiment, a separate electromagnetic coil and separate magnetic circuit may be used for controlling the viscosity of the hydraulic fluid.

In another alternative preferred embodiment, a piezoelectric element (i.e., a piezostack) is used to actuate the fuel injector valve. In this embodiment, the charging voltage of the piezostack may be used to maintain a current in the solenoid electromagnetic coil of the magneto-hydraulic compensator. This embodiment provides a two-terminal device, while providing both piezoelectric and magneto-hydraulic performance.

In a preferred embodiment, the hydraulic fluid that changes viscosity in the presence of a magnetic field includes small ferromagnetic or ferromagnetic particles suspended in a carrier fluid, such as silicone oil, synthetic oil, mineral oil, esters, etc. The initial viscosity of the resulting fluid is typically close to the viscosity of the carrier fluid alone. However, when a magnetic field is applied to the fluid, the viscosity of the fluid increases nearly linear with field intensity until the fluid becomes nearly solid, displaying a yield strength, at magnetic saturation (see, e.g., FIG. 5). Varieties of this type of magnetically-active fluid may be referred to as either magneto-rheologic (i.e., suspended particles in the approximately micron range of size) or ferrofluid (i.e., suspended particles in the approximately sub-micron or nanometer range of size).

In a preferred embodiment, the magnetostrictive member 124 (e.g., Terfenol-D) is placed in the fuel path for cooling and ease of construction. Because Terfenol-D resists corrosion and is not adversely affected by nonionic hydrocarbons, such as gasoline or diesel fuel, there is no need for an isolating mechanism such as a metal bellows, diaphragm or O-ring seal, such as may be needed in a piezoelectric injector, thereby simplifying the construction and reducing the moving mass of the valve mechanism.

The magnetically-controlled thermal expansion compensator disclosed herein is believed to provide at least the following: (1) De-coupled temperature dependence of viscosity because, in a preferred embodiment, viscosity is primarily determined by magnetic field intensity; (2) Use of larger clearances and tolerances in production due to the ability to vary viscosity as needed; (3) Damping of motion by the compensator occurs only when the device is energized, eliminating the need for a check valve, and allowing less damping when needed during thermal transients and initial assembly (the ability to dynamically vary fluid viscosity acts like virtual check valve); (4) Performance substantially independent of fuel pressure; (5) Fast response times due to magnetic field dependence; (6) Allows for very accurate duration injector pulse widths, including, for example, operation with direct injection pulse widths of less than 5 milliseconds and longer port injector-type pulse widths from 5 milliseconds to greater than 20 milliseconds, allowing for "limp-home" operation in case of an unexpected fuel system pressure drop; (7) High damping that occurs during injector actuation only; (8) No pressurization of the fluid in the compensator is necessary prior to installation of the compensator in the fuel injector; in other words, pressurization of the fluid in the compensator the pressurized fuel entering the fuel injector, and (9) a second biasing member acts as a refill mechanism to draw fluid into the first volume 10 instead of ed refill source such as an engine lubrication pressure.

While the presentin invention has been disclosed with reference to certain preferred fications, alterations, and changes to the described embodiments g from the sphere and scope of the present invention, as defined rdingly, it is intended that the present invention not be limited to but that it have the full scope defined by the language of the ents thereof.

What is claimed

1. A fuel injector comprising:

a body having an inlet port, an outlet port and a fuel passageway extending from the inlet port to the outlet port along a longitudinal axis;

a metering element disposed proximate the outlet port;

an actuation element having a proximal end and a distal end, the proximal end being in operative contact with the metering element;

an electromagnetic coil; and a compensator being coupled to the distal end of the actuation element via a plunger, the compensator having a chamber formed between the plunger and a sleeve to define a volume. the chamber containing a generally constant volume of magnetically-active fluid, the magnetically-active fluid being responsive to magnetic flux so as to change the fluid from a first state to a second state to generally prevent movement of the plunger relative to the sleeve.

2. A fuel injector comprising:

a body having an inlet port, an outlet port and a fuel passageway extending from the inlet port to the outlet port along a longitudinal axis:

a metering element disposed proximate the outlet port;

an actuation element having a proximal end and a distal end, the proximal end being in operative contact with the metering element:

an electromagnetic coil, and a compensator being coupled to the distal end of the actuation element, the compensator containing magnetically-active fluid, the magnetically-active fluid being responsive to magnetic flux so as to change the fluid from a first state to a second state, the compensator including:

a sleeve extending between a first end and a second end along the longitudinal axis, one of the first and second ends having an opening and the other of the first and second end is closed;

a plunger extending between a first plunger end and a second plunger end along the longitudinal axis, the first plunger end being cinctured by the sleeve and spaced apart with a portion of the plunger by a clearance, the plunger having an opening formed on the plunger and extending into the plunger for a predetermined distance so as to form an interior volume;

a seal disposed between the sleeve and the plunger so as to define a first volume between the other of the first and second ends of the sleeve and the plunger;

a plunger guide having a fluid passage extending between a first guide end and a second guide end, one of the first guide end and second end being disposed at least partly in the interior volume of the plunger so as to define a second volume; and a biasing member disposed between the plunger guide and the interior volume.

3. The fuel injector according to claim 2, wherein the electromagnetic coil generates at least a portion of the magnetic flux.

4. The fuel injector according to claim 2, wherein the electromagnetic coil is coupled to the actuation element such that the metering element is operative to move when the electromagnetic coil is energized.

5. The fuel injector according to claim 2, wherein the actuation element comprises a magnetostrictive member.

6. The fuel injector according to claim 5, wherein the magnetostrictive rod comprises a Terfenol-D alloy.

7. The fuel injector according to claim 5, wherein at least a portion of the magnetostrictive member is exposed to fuel.

8. The fuel injector according to claim 5, further comprising a biasing means operatively positioned to exert a predetermined prestress force on the magnetostrictive rod.

9. The fuel injector according to claim 8, wherein the biasing means biases the plunger away from the sleeve so as to cause magnetically-active fluid to flow between the second volume and at least one of the clearance and the first volume.

10. The fuel injector according to claim 2, wherein the actuation element comprises a piezoelectric stack.

11. The fuel injector of claim 10, wherein the charging voltage of the piezostack is used to maintain a current in the electromagnetic coil proximate the compensator.

12. The fuel injector according to claim 10, wherein the biasing means controls the amount of magnetically-active fluid passing through between the first volume and the second volume.

13. The fuel injector according to claim 2, wherein the first state comprises a liquid and the second state comprises the liquid in a substantially solidified state so that movement of the magnetically-active fluid between the clearance is reduced or prevented.

14. The fuel injector according to claim 2, wherein the first state comprises a fluid having a first viscosity and the second state comprises a second viscosity greater than the first viscosity so that movement of the fluid between the first volume, the clearance and the second volume is reduced or prevented.

15. The fuel injector according to claim 14, wherein the second viscosity comprises a viscosity approximately four orders of magnitude different from the first viscosity.

16. The fuel injector according to claim 2, wherein the body comprises an inlet assembly having the sleeve formed therein.

* * * * *